United States Patent [19]

Wilson

[11] Patent Number: 4,959,099

[45] Date of Patent: Sep. 25, 1990

[54] TAPER ROLLING OF METAL

[75] Inventor: Alexander I. Wilson, Sheffield, England

[73] Assignee: Ian Wilson Technology Limited, Sheffield, England

[21] Appl. No.: 308,835

[22] Filed: Feb. 9, 1989

[30] Foreign Application Priority Data

Jan. 14, 1988 [GB] United Kingdom ..... 8800792

[51] Int. Cl.[5] ..... B21B 31/30

[52] U.S. Cl. ..... 72/244; 72/240

[58] Field of Search ..... 72/240, 244, 237, 250, 72/199

[56] References Cited

U.S. PATENT DOCUMENTS

| | | | |
|---|---|---|---|
| 939,167 | 11/1909 | Sack | 72/244 |
| 3,247,697 | 4/1966 | Cozzo | 72/240 |
| 3,369,383 | 2/1968 | Barnikel | 72/244 |
| 3,507,139 | 4/1970 | Sturdy et al. | 72/244 |
| 3,517,531 | 6/1970 | Strance | 72/244 |
| 3,789,646 | 2/1974 | Sendzimir | 72/240 |
| 4,171,633 | 10/1979 | Sebardt | 72/250 |

*Primary Examiner*—Daniel C. Crane

*Attorney, Agent, or Firm*—Samuels, Gauthier & Stevens

[57] ABSTRACT

Taper rolling apparatus including a pair of rolls (10,12) the spacing of which can be varied according to the linear movement of a workpiece clamped in a carriage assembly (26). So that the roll gap can remain at a constant mean height throughout the rolling operation, mechanism including a horizontally disposed wedge member (56) is provided, the wedge member being constrained to move along a horizontal path and effecting the adjustment of pairs of roll chocks (44,44 and 46,46) bearing against the opposite sides of said wedge member.

11 Claims, 4 Drawing Sheets

TAPER ROLLING OF METAL

FIELD OF THE INVENTION

The invention relates to the taper rolling of metal, more specifically to the rolling of accurately tapered workpieces such as tapered leaf springs for vehicles.

It is known to taper roll a length of metal by drawing it between a pair of rolls and simultaneously varying the spacing between the rolls in accordance with the linear movement of the workpiece. The spacing of the rolls may be varied by actuator means operated by a signal derived by generating a signal indicative of progress of the workpiece along its traverse movement and comparing it with a signal indicative of actual roll spacing. Alternatively, the spacing of the rolls may be varied by a master profile, the latter having either a physical nature e.g., being in the nature of a shaped block, or it may be constituted by stored data, e.g., data stored on cards, tape or the like from which control signals can be derived. In order to reduce to a minimum the lateral spread of the workpiece as it passes between the rolls, and to ensure that the workpiece is maintained as straight as possible, the rolls may be driven with insufficient torque to drive the workpiece between them, a drawbar pull providing some part of the force for passing the workpiece between the rolls so that the workpiece tends to be maintained in a straight condition. However, in fact, the main force for driving the workpiece between the rolls may be provided by the roll drive. A pair of freely rotatable auxiliary rolls are generally provided to control the lateral spread of the workpiece, the edges of the workpiece being rolled by said auxiliary rolls during at least one of the passes between the main rolls, and possibly during each pass.

Taper rolling apparatus of the kind just described is prone to one particular problem, this being that if the roll gap does not remain at a constant mean height throughout the rolling operation the workpiece during at least some part of the rolling operation is subjected to bending forces because the drawbar pull is applied at a height offset from the axis of the workpiece.

The object of the invention is to provide a remedy for this problem by providing relatively simple means whereby, throughout the rolling operation, the roll gap remains at a constant mean height.

SUMMARY OF THE INVENTION

According to the invention, there is provided apparatus for the taper rolling of metal, the apparatus including at least a pair of main rolls mounted for rotation in roll housing and defining a roll gap through which a workpiece blank can be drawn by a drawbar arrangement, control means being provided whereby, simultaneously, the spacing between the rolls can be varied in accordance with the linear movement of the workpiece, in which respective pairs of roll chocks for upper and lower rolls defining the roll gap are located by mechanism which ensures that the roll gap remains at a fixed height throughout the rolling operation, said mechanism including a horizontally disposed wedge member constrained to move along a horizontal path under the influence of the control means, one of the pair of roll chocks abutting against one inclined surface of the wedge member and the other pair of roll chocks abutting against the other inclined surface of the wedge member. The horizontally disposed wedge member will preferably be constrained to move along a horizontal path by pairs of rollers at its opposite ends, said rollers engaging respective slots in vertical walls of the roll housing. If the wedge member is located above the rolls, the roll chocks for a lower one of the pair of main rolls may be seated on a lower cross block connected to upstanding slide plates which are slidably mounted for vertical adjustment in vertical walls of the roll housing, said lower cross block, together with an upper cross block, connecting the upstanding slide plates together to form a sash-like frame slidably adjustable in the roll housing, the upper cross block being seated on the upper inclined surface of the wedge member and there being an intermediate cross block immediately below the wedge member and in contact with its lower inclined surface, the roll chocks for an upper one of the pair of main rolls being suspended beneath and in contact with said intermediate cross block, the arrangement being such that as the wedge member is traversed along its horizontal path of movement, the upper cross block and the intermediate cross block are varied in their spacing from each other, depending upon the direction of movement of the wedge member, with equal and opposite movement of said cross blocks, the main rolls thus being adjusted with equal an opposite movement to vary the roll gap about a constant height pass line. In this case, the intermediate cross block may be retained in contact with the lower inclined surface of the wedge member by means of upstanding lug portions of said cross block, said lug portions being provided with respective rollers which engage slots in the opposite side surfaces of the wedge member, said slots extending parallel to the inclined lower surface of said wedge member. On the other hand, if the wedge member is located beneath the rolls, the roll chocks for an upper one of the pair of main rolls may be retained in abutment with an upper cross block connected to upstanding slide plates which ar slidably mounted for vertical adjustment in vertical walls of the roll housing, said upper cross block, together with a lower cross block, connecting the upstanding slide plates together to form a sash-like frame slidably adjustable in the roll housing, the roll chocks for the lower one of the pair of main rolls in this case being seated on the upper inclined surface of the wedge member and the lower cross block being suspended beneath and in contact with the lower inclined surface of the wedge member, the arrangement being such that as the wedge member is traversed along its horizontal path of movement, the roll chocks for the lower one of the pair of main rolls and the lower cross block are varied in their spacing from each other, depending upon the direction of movement of the wedge member, with equal and opposite movement of said roll chocks and cross block, the main rolls thus being adjusted with equal and opposite movement to vary the roll gap about a constant height pass line. In this case, the lower cross block may be retained in contact with the lower inclined surface of the wedge member by means of rollers which are carried by the upstanding slide plates which are mounted for vertical adjustment in the vertical walls of the roll housing, said rollers engaging slots in the opposite side surfaces of the wedge member, said slots extending parallel to the inclined lower surface of said wedge member.

The horizontal component of force which is applied to the elements immediately above and below the wedge member when the latter is advanced to reduce the roll gap may be taken by a pair of freely rotatable rollers which are mounted in the roll housing.

A pair of auxiliary rolls may be disposed on the side of the main rolls remote from the drawbar arrangement and in a plane perpendicular to a plane containing the axes of the main rolls so that lateral spread of the deformable blank can be controlled. Said pair of auxiliary rolls ma be carried by respective bell-crank levers mounted on respective upstanding pivot pins, the positions of said auxiliary rolls towards and away from each other being controlled by respective double acting rams. The amount by which the auxiliary rolls can be brought towards each other, that is to say the setting which defines the minimum width of the rolled product, may be determined by the setting of adjusting screws which constitute positive stops acting against the frame of the roll housing. The frame of the roll housing and the roll chocks for the main rolls may be appropriately cut away to allow the auxiliary rolls to be positioned a close as possible to the main rolls.

In order that the invention may be fully understood and readily carried into effect, the same will now be described, by way of example only, with reference to the accompanying drawings, of which:

Figure 1:
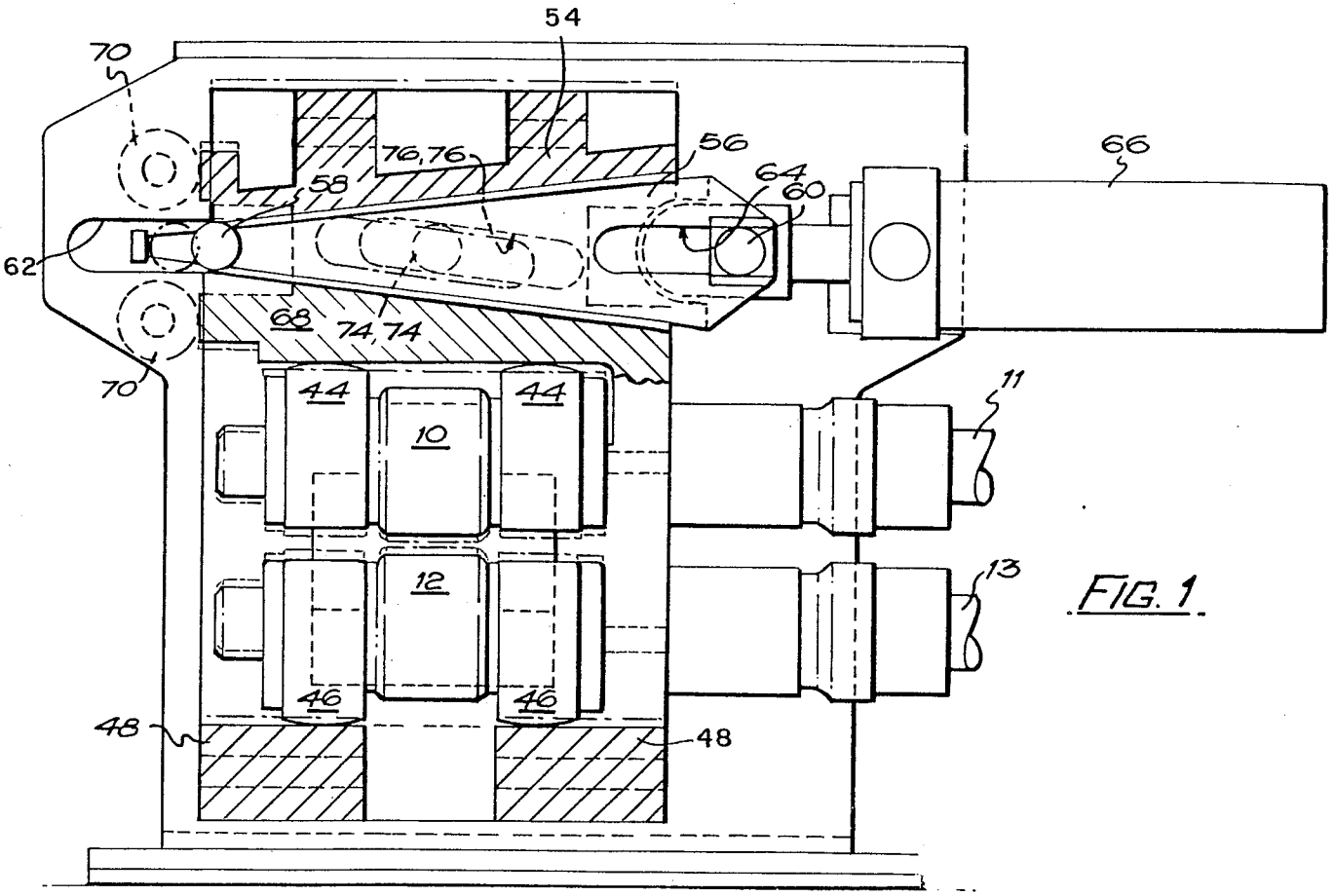
FIG. 1 is a front elevation of apparatus embodying the invention.

Referring now to the drawings, the apparatus there illustrated for the taper rolling of metal includes a pair of main rolls 10,12 mounted for rotation in a roll housing generally indicated 14, said main rolls being drivable, respectively, by means of universally jointed shafts 11 and 13. On the output side of the main rolls there is located a drawbar arrangement generally indicated 16 to which a heated blank can be connected, by clamping means generally indicated 18, the drawbar arrangement being movable linearly by a hydraulic ram 20.

The main rolls 10,12 define a roll gap through which the heated blank can be passed, control means (which will be described presently) being provide whereby, simultaneously, the spacing between the rolls can be varied in accordance with the linear movement of the workpiece. The deformable blank workpiece will in fact generally be drawn between the main rolls a number of times to reduce it to the required form. The heated blank is passed through the roll gap by means of the roll drive and drawbar pull in combination. It has been found necessary for the main force for driving the heated blank through the roll gap to be provided by the roll drive, but the drawbar pull has been found to be effective in maintaining the workpiece in straight condition as it passes between the main rolls.

A pair of auxiliary rolls 22,22 (see FIG. 2) are disposed on the side of the main rolls remote from the drawbar arrangement, and in a plane perpendicular to a plane containing the axes of the main rolls, so that lateral spread of the deformable blank can be controlled. The auxiliary rolls will be brought into operation during at least one of the passes through the main rolls, and in fact it may be found that to control the lateral spread in the most effective manner they need to be brought into operation during each pass.

Figure 2:
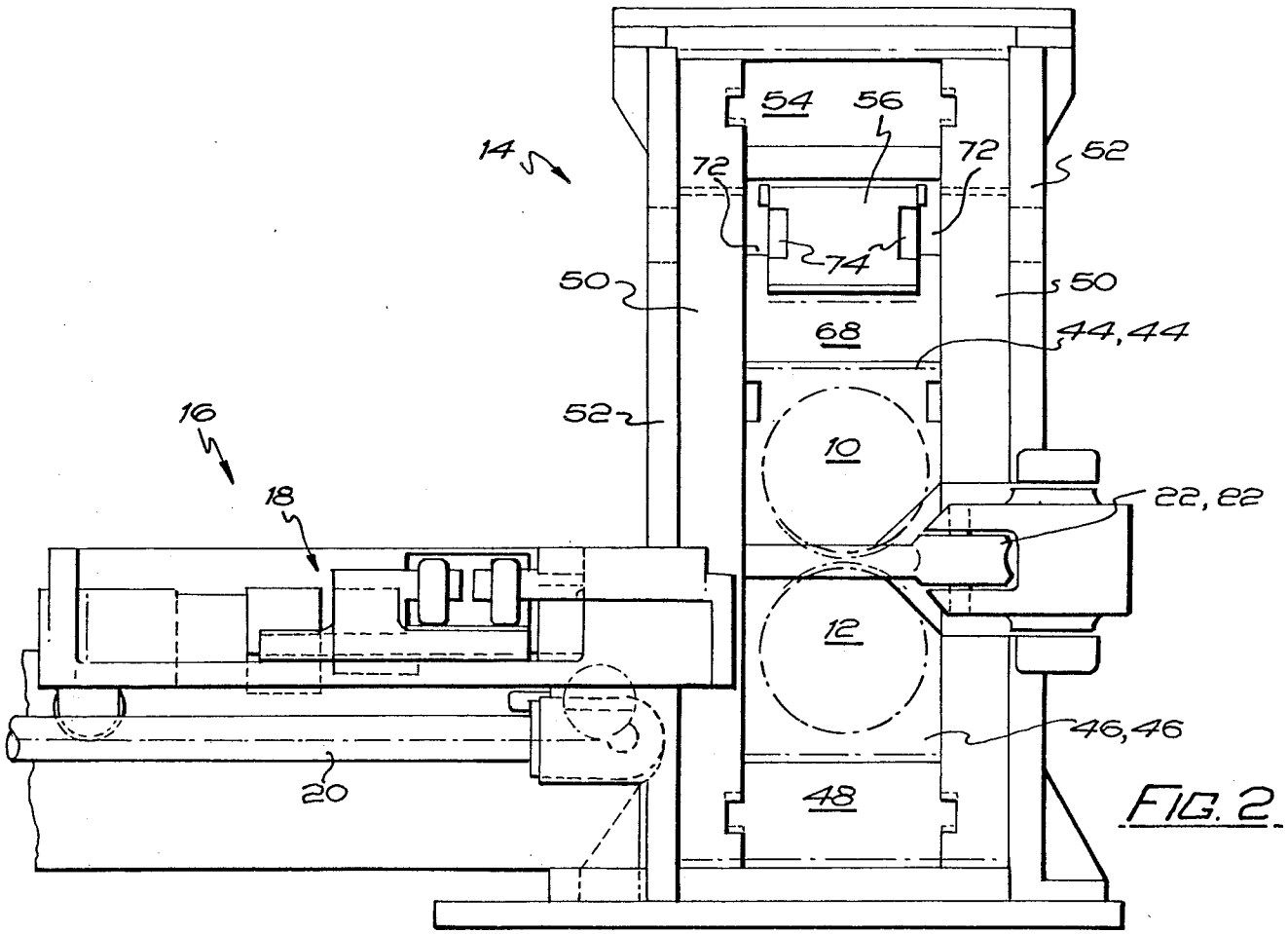
FIG. 2 is a side elevation.
Figure 3:
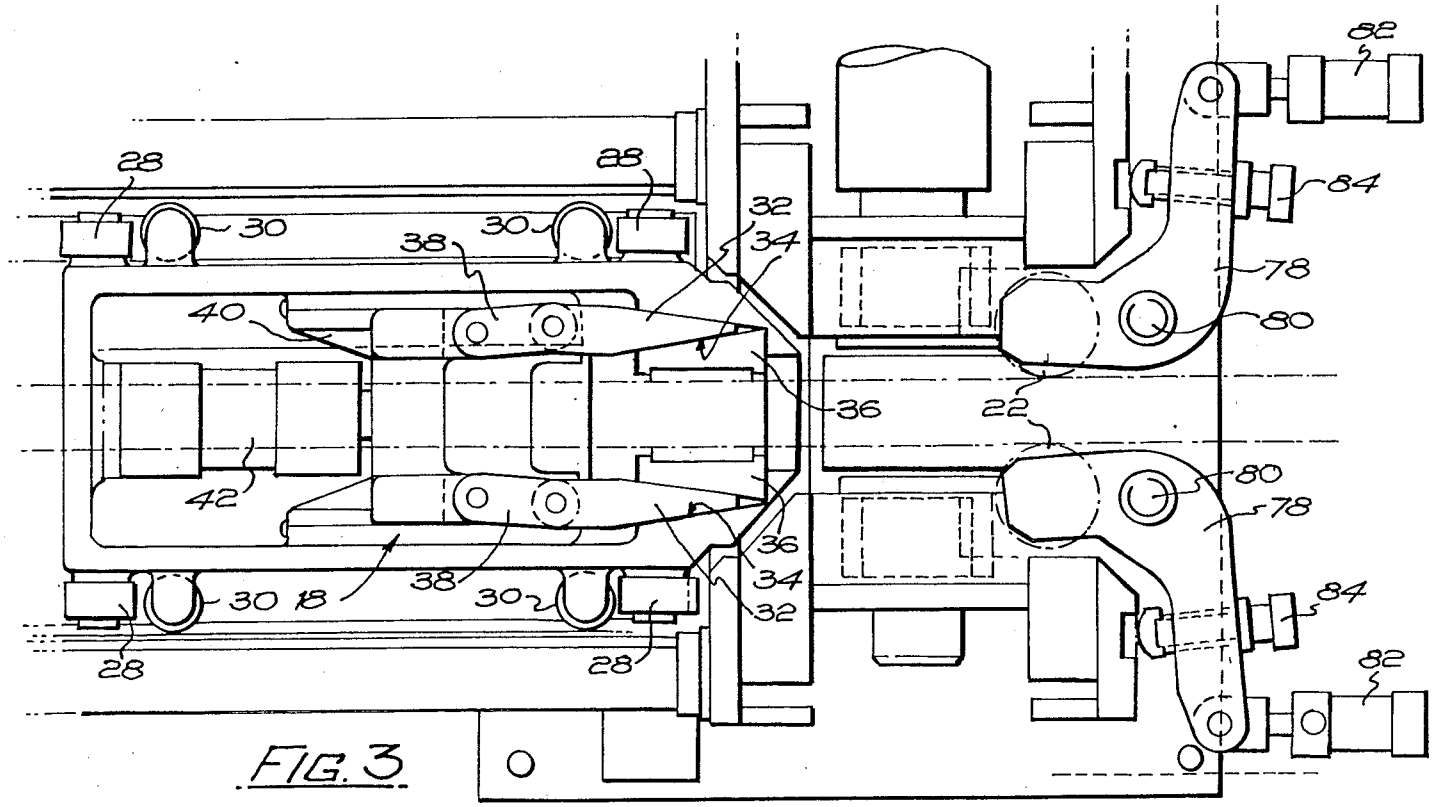
FIG. 3 is a plan view partly in section.

The clamping means 18, for connecting the heated blank to the drawbar arrangement, are located in a carriage assembly generally indicated 26 (see FIG. 3). As shown in FIGS. 2 and 3, the carriage assembly is mounted on pairs of rollers 28,28 which together with further pairs of rollers 30,30 guide the carriage assembly linearly along fixed guide structure projecting rearwardly from the roll housing. The clamping means 18 are constituted by a pair of wedge members 32,32 which are located between respective upstanding and converging walls 34,34 at a tapering end portion of the carriage and respective clamping blocks 36,36 which contact the side surfaces of the heated workpiece blank. The wedge members are connected, by means of respective links 38,38 and a slidably mounted yoke member 40, to a hydraulic double acting ram 42 for driving the wedge members into operative or inoperative positions. Throughout the operation of the apparatus, the heated blank is traversed backwards and forwards between the main rolls at a constant height determined by its location in the carriage 26, the latter being traversable along the fixed guide structure.

Referring now in particular to FIGS. 1 and 2, the main rolls 10,12 are located in respective pairs of roll chocks 44,44 and 46,46. The roll chocks 46,46 are seated on a lower cross block 48 which is connected, as shown, to upstanding slide plates 50,50 (see FIG. 2) which are slidably mounted for vertical adjustment in vertical walls 52,52 of the roll housing. Together with an upper cross block 54, the lower cross block 48 connects the upstanding slide plates to form a sash-like frame slidably adjustable in the roll housing.

In an upper part of the roll housing there is located a horizontally disposed wedge member 56 which is constrained to move along a horizontal path by pairs of rollers 58 and 60 at its opposite ends which engage slots 62 and 64 respectively in the vertical walls of the roll housing. As shown, the wedge member is connected to a hydraulic ram 66 by means of which it can be traversed along its horizontal path of movement. The wedge member is symmetrical about its horizontal medial line as shown.

The upper cross block 54 which forms part of the sash-like frame referred to is seated on the upper inclined surface of the wedge member. Immediately below the wedge member and in contact with it lower inclined surface is an intermediate cross block 68 beneath which the roll chocks 44,44 are suspended. Consequently, it will be seen that as the wedge member is traversed along its horizontal path of movement by the hydraulic ram 66, the upper cross block and the intermediate cross block are moved towards or away from each other, depending upon the direction of movement of the wedge member, with equal and opposite movement. The rolls are thereby adjusted with equal and opposite movement to reduce or increase the roll gap about a constant height pass line.

As shown in chain-dotted lines in FIGS. 1 and 2, when the wedge member has been advanced, for example, through the horizontal distance indicated, the upper cross block 54 and with it the slide plates 50,50 and the lower cross block 48 have been raised by the vertical distance indicated. Simultaneously, the intermediate cross block 68 has been lowered by that same vertical distance. Consequently, the main rolls have each been moved towards the other by that same vertical distance to reduce the roll gap but the pass line has remained unchanged.

The horizontal component of force which is applied to the upper and intermediate cross blocks when the wedge member is advanced to reduce the roll gap is taken by a pair of freely rotatable rollers 70,70 which are mounted in that side of the roll housing remote from the hydraulic ram 66.

The intermediate cross block 68 is retained in contact with the lower inclined surface of the wedge member by means of upstanding lug portions 72,72 (see FIG. 2) of said cross block, these being provided with respective rollers 74,74 which engage slots 76,76 in the opposite side surfaces of the wedge member. The slots extend in parallel with the inclined lower surface of said wedge member so that as the wedge member is traversed along its horizontal path, the intermediate cross block is caused to move up or down but is retained in contact with said wedge member at all times.

The arrangement is such that, as previously described, a heated blank can be drawn through the roll gap by the drawbar arrangement whilst the spacing between the rolls is simultaneously varied in accordance with the linear movement of the workpiece. This is of course done by pumping hydraulic fluid to the ram 66 at a rate dependent upon the rate at which the drawbar arrangement operates. (The control means referred to earlier may include means for generating a signal indicative of the progress of the material through the roll gap, means for generating a signal indicative of the desired spacing of the rolls according to the progress of the material through the roll gap, and means for indicating the actual spacing of the rolls, the rate at which hydraulic fluid is pumped to the ram 66 being varied in response to an error signal which is the result of a comparison between the desired spacing signal and the actual spacing signal). Throughout the rolling operation, the adjustment of the roll gap in the manner described, so that, a constant pass line is maintained, thus ensuring that the heated blank is not subjected to bending about the region in which it is clamped upon the drawbar arrangement. The result is that the tapered product produced is of high quality and with no tendency to bend from the required straight form.

The pair of auxiliary rolls 22,22 which are disposed on the side of the main rolls remote from the drawbar arrangement are carried by respective bell-crank levers 78,78 pivotally mounted on respective upstanding pivot pins 80,80. The positions of said auxiliary rolls are controlled by respective double acting rams 82,82 the piston rods of which are pivotally connected to the bell-crank levers. The amount by which the auxiliary rolls can be brought towards each other, that is to say the setting which defines the minimum width of the rolled product, is determined by the setting of adjusting screws 84,84 which constitute positive stops acting against the frame of the roll stand. As shown, the frame of the roll stand and the roll chocks are cut away in the region of the auxiliary rolls to allow the latter to be positioned as close as possible to the main rolls.

Thus there is provided apparatus for the taper rolling of metal, the apparatus having very simple means whereby, throughout the rolling operation, the roll gap remains at a constant mean height so that a workpiece is not subjected to bending forces which could be of detriment to the finished product. It is particularly advantageous that the wedge member is located above the rolls because in this position it can be expected to remain free from scale and swarfe which could damage its working surfaces. However, it is not essential for the wedge member to be located above the rolls, and in FIG. 4 there is illustrated a modified arrangement in which the wedge member is located beneath the rolls.

Figure 4:
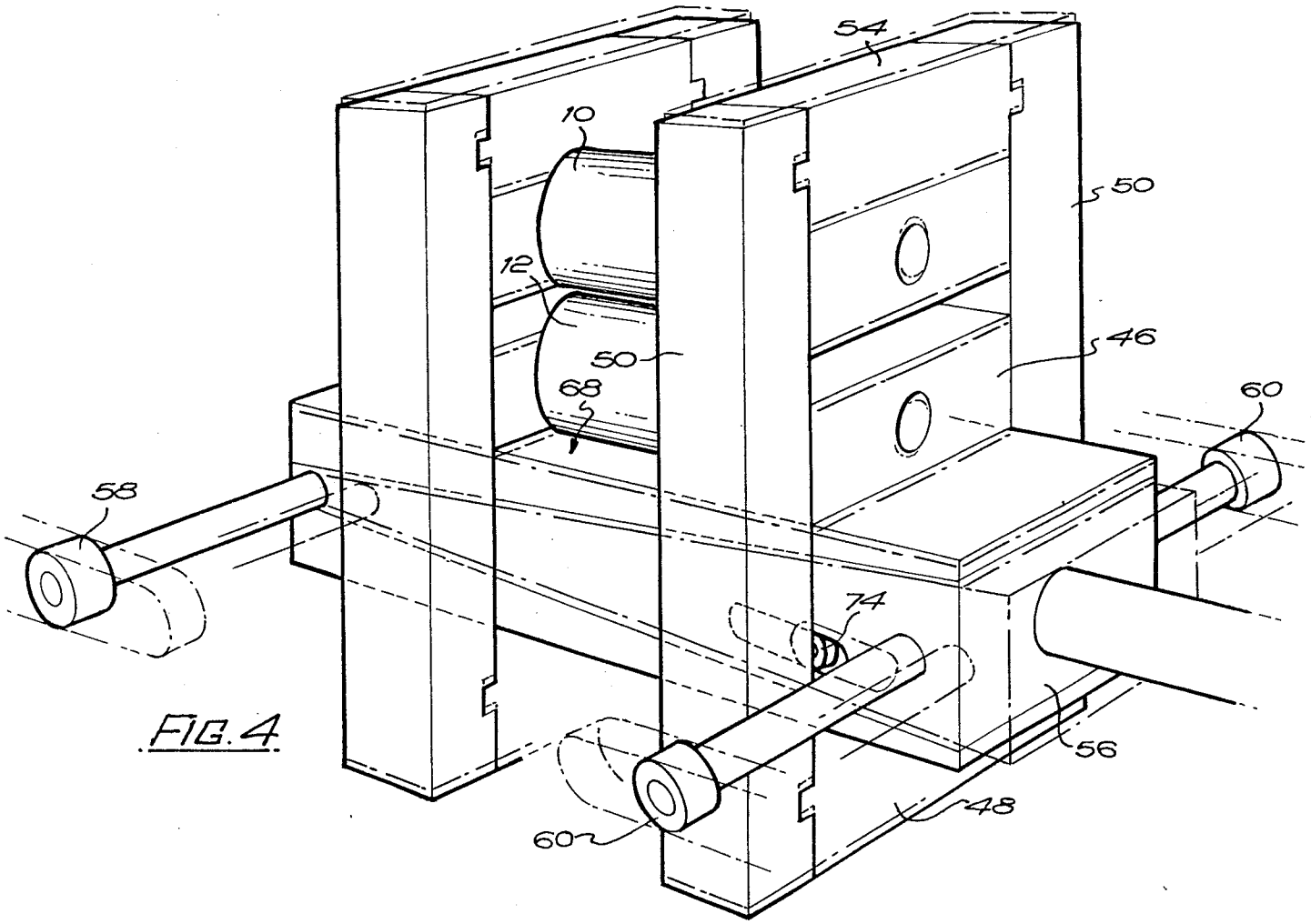
FIG. 4 is a schematic view which will be referred to when describing a possible modification.

Referring to FIG. 4, there is there illustrated schematically, an arrangement in which the wedge member 56 is located beneath the rolls. As shown, the wedge member is located between the lower cross block 48 and the intermediate block 68. The lower roll chocks 46 in this case rest upon the intermediate block. The upper roll chocks are retained in abutment with the upper cross block 54 by means not shown.

The lower cross block structure 48 is in this case retained in contact with the lower inclined surface of the wedge member by means of rollers 74,74 which in this case are carried by the upstanding slide plates 50,50 which are slidably mounted for vertical adjustment in the vertical walls of the roll housing. As in the previously described embodiment, during traverse movements of the wedge member along its horizontal path of movement, guided by the pairs of rollers 58 and 60, the lower cross block 48 and the intermediate cross block structure are moved towards or away from each other, depending upon the direction of movement of the wedge member, with equal and opposite movement. The rolls are therefore adjusted with equal and opposite movement to reduce or increase the roll gap about the constant height pass line.

As shown in chain-dotted lines in FIG. 4, when the wedge member has been retracted, for example, through the horizontal distance indicated, the intermediate cross block structure is lowered by the vertical distance indicated to lower the roll 12 by that same distance. Simultaneously, the lower cross block structure 48 and with it the upper cross block structure 54 is raised by that amount because of the fact that the rollers 74, 74 are carried by the upstanding slide plates 50,50 and the fact that the slots 76,76 in the side surfaces of the wedge member extend in parallel with the inclined lower surface of said wedge member. The arrangement is such that the lower cross block structure remains always in contact with the wedge member.

With the wedge member located beneath the rolls, means will of course be provided to guard against the ingress of scale and swarfe to its working surfaces.

Various other modifications may be made to the rolling mill apparatus described above. For example, it would be quite possible for the invention described above to be applied to a three-high or four-high installation where at least one of the main rolls 10,12 is a back up roll for a much smaller diameter roll. The control means by which the spacing of the main rolls is varied in accordance with the linear movement of the workpiece can of course be of any preferred form.

What I claim and desire to secure by Letters Patent is:

1. Apparatus for the taper rolling of metal, the apparatus including at least a pair of main rolls mounted for rotation in a roll housing and defining a roll gap through which a workpiece blank can be drawn by a drawbar arrangement, control means being provided whereby, simultaneously, the spacing between the rolls can be varied in accordance with the linear movement of the workpiece, in which respective pairs of roll chocks for upper and lower rolls defining the roll gap are located by a mechanism for ensuring that the pass line remains at a fixed height throughout the rolling operation, said mechanism including a horizontally disposed wedge member having oppositely directed inclined surfaces constrained to move along a horizontal path under the influence of the control means, the roll chocks for one of the main rolls abutting against one inclined surface of the wedge member and the roll chocks for the other of the main rolls being carried in a sash-like frame having upstanding slide plates of which are slidably mounted for vertical adjustment in the roll housing and a cross block of which abuts against the other inclined surface of the wedge member, whereby, despite the pairs of roll chocks not being located on opposite sides of the wedge member, one of the pair of roll chocks abuts against one inclined surface of said wedge member and the other pair of roll chocks in effect abuts against the other inclined surface of said wedge member so that movement of said wedge member along said horizontal path moves both said main rolls either towards or away from one another while maintaining said pass line at said fixed height.

2. Apparatus according to claim 1, in which the horizontally disposed wedge member is constrained to move along a horizontal path by pairs of rollers at its opposite ends, said rollers engaging respective slots in vertical walls of the roll housing.

3. Apparatus according to claim 1, in which the wedge member is located above the rolls, the roll chocks for a lower one of the pair of main rolls being seated on a lower cross block connected to the upstanding slide plates which are slidably mounted for vertical adjustment in vertical walls of the roll housing, said lower cross block, together with an upper cross block, connecting the upstanding slide plates together to form the sash-like frame slidably adjustable in the roll housing, the upper cross block being seated on the upper inclined surface of the wedge member and there being an intermediate cross block immediately below the wedge member and in contact with its lower inclined surface, the roll chocks for an upper one of the pair of main rolls being suspended beneath and in contact with said intermediate cross block, whereby, as the wedge member is traversed along its horizontal path of movement, the upper cross block and the intermediate cross block are varied in their spacing from each other, depending upon the direction of movement of the wedge member, with equal and opposite movement of the said cross blocks, the main rolls thus being adjusted with equal and opposite movement to vary the roll gap about the fixed height pass line.

4. Apparatus according to claim 3, in which the intermediate cross block is retained in contact with the lower inclined surface of the wedge member by means of upstanding lug portions of said cross block, said lug portions being provided with respective rollers which engage slots in the opposite side surfaces of the wedge member, said slots extending parallel to the inclined lower surface of said wedge member.

5. Apparatus according to claim 1, in which the wedge member is located beneath the rolls and the roll chocks for an upper one of the pair of main rolls are retained in abutment with respective upper cross blocks connected to the upstanding slide plates which are slidably mounted for vertical adjustment in vertical walls of the roll housing, said upper cross block, together with a lower cross block, connecting the upstanding slide plates together to form the sash-like frame slidably adjustable in the roll housing, the roll chocks for the lower one of the pair of main rolls being seated on the upper cross block being seated suspended beneath and in contact with the lower inclined surface of the wedge member, whereby as the wedge member is traversed along its horizontal path of movement, the roll chocks for the lower one of the pair of main rolls and the lower cross block are varied in their spacing from each other, depending upon the direction of movement of the wedge member, with equal and opposite movement of said roll chocks and cross block, the main rolls thus being adjusted with equal and opposite movement to vary the roll gap about the fixed height pass line.

6. Apparatus according to claim 5, in which the lower cross block is retained in contact with the lower inclined surface of the wedge member by means of rollers which are carried by the upstanding slide plates mounted for vertical adjustment in the vertical walls of the roll housing, said rollers engaging slots in the opposite side surfaces of the wedge member, said slots extending parallel to the inclined lower surface of said wedge member.

7. Apparatus according to claim 1, in which the horizontal component of force which is applied to the elements immediately above and below the wedge member when the latter is advanced to reduce the roll gap is taken by a pair of freely rotatable rollers which are mounted in the roll housing.

8. Apparatus according to claim 1, in which a pair of auxiliary rolls are disposed on the side of the main rolls remote from the drawbar arrangement and in a plane perpendicular to a plane containing the axes of the main rolls so that lateral spread of the deformable blank can be controlled.

9. Apparatus according to claim 8, in which the pair of auxiliary rolls are carried by respective bell-crank levers mounted on respective upstanding pivot pins, the positions of said auxiliary rolls towards and away from each other being controlled by respective double acting rams and the amount by which the auxiliary rolls can be brought towards each other, that is to say the setting which defines the minimum width of the rolled product, being determined by the setting of adjusting screws which constitute positive stops acting against the frame of the roll housing.

10. Apparatus according to claim 8, in which the amount by which the auxiliary rolls can be brought towards each other, that is to say the setting which defines the minimum width of the rolled product, is determined by the setting of adjusting screws which constitute positive stops acting against the frame of the roll housing.

11. Apparatus according to claim 8, in which a frame of the roll housing and the roll chocks for the main rolls are appropriately cut away to allow the auxiliary rolls to be positioned as close as possible to the main rolls.

* * * * *